US009629413B2

(12) United States Patent
Stien

(10) Patent No.: US 9,629,413 B2
(45) Date of Patent: Apr. 25, 2017

(54) FOOTWEAR WITH TAPERED HEEL, SUPPORT PLATE, AND IMPACT POINT MEASUREMENT METHODS THEREFORE

(71) Applicant: Karl Stien, Eau Claire, WI (US)

(72) Inventor: Karl Stien, Eau Claire, WI (US)

( * ) Notice: Subject to any disclaimer, the term of this patent is extended or adjusted under 35 U.S.C. 154(b) by 0 days.

(21) Appl. No.: 15/078,628

(22) Filed: Mar. 23, 2016

(65) Prior Publication Data

US 2016/0278476 A1 Sep. 29, 2016

Related U.S. Application Data

(60) Provisional application No. 62/136,756, filed on Mar. 23, 2015.

(51) Int. Cl.

| | |
|---|---|
| ***A43B 13/12*** | (2006.01) |
| ***A43B 7/20*** | (2006.01) |
| ***A43B 13/18*** | (2006.01) |
| ***A43B 13/14*** | (2006.01) |

(52) U.S. Cl.

CPC ..... *A43B 7/20* (2013.01); *A43B 13/12* (2013.01); *A43B 13/143* (2013.01); *A43B 13/145* (2013.01); *A43B 13/181* (2013.01)

(58) Field of Classification Search

CPC ..... A43B 13/00; A43B 13/12; A43B 13/14; A43B 13/141; A43B 13/143; A43B 13/145; A43B 13/146; A43B 13/16

USPC ..... 36/25 R, 30 R, 103, 107, 27, 102, 142, 36/143, 144

See application file for complete search history.

(56) References Cited

U.S. PATENT DOCUMENTS

| | | | | |
|---|---|---|---|---|
| 1,177,777 | A | 4/1916 | Kelley | |
| 1,872,604 | A | 8/1932 | Pierce | |
| 1,979,391 | A | 11/1934 | Laybott | |
| 4,128,950 | A | 12/1978 | Bowerman et al. | |
| 4,237,625 | A | 12/1980 | Cole et al. | |
| 4,722,144 | A | 2/1988 | Beerli | |
| 4,854,057 | A * | 8/1989 | Misevich | A43B 13/12 36/107 |
| 5,179,791 | A * | 1/1993 | Lain | A43B 17/06 36/144 |
| 5,507,106 | A * | 4/1996 | Fox | A43B 13/143 36/103 |
| 5,727,335 | A * | 3/1998 | Kousaka | A43B 7/14 36/140 |
| 5,752,330 | A | 5/1998 | Snabb | |
| 5,875,567 | A | 3/1999 | Bayley | |
| 6,029,374 | A | 2/2000 | Herr et al. | |
| 6,055,746 | A | 5/2000 | Lyden et al. | |

(Continued)

FOREIGN PATENT DOCUMENTS

| | | |
|---|---|---|
| EP | 0600145 | 6/1994 |
| EP | 0860121 | 8/1998 |

*Primary Examiner* — Marie Bays

(74) *Attorney, Agent, or Firm* — Anthony J. Bourget

(57) ABSTRACT

An article of footwear having a tapered heel in part defining an impact point associated with a padded impact zone which first strikes a surface upon a foot plant and a plate embedded within a sole of the article such that the plate supports the heel of the sole from flexing or collapsing, the impact point positioned anterior a pivot point of the wearer's ankle. In one aspect the plate avoids positioning at a lateral midfoot area of the sole to allow for impact zone padding and promotes avoiding or reducing heel strike forces when walking or running.

34 Claims, 9 Drawing Sheets

(56) References Cited

U.S. PATENT DOCUMENTS

| | | | | |
|---|---|---|---|---|
| 6,131,315 | A * | 10/2000 | Frye | A43B 3/163 36/103 |
| 6,260,289 | B1 * | 7/2001 | Tsuji | A43B 13/12 36/103 |
| 6,393,735 | B1 | 5/2002 | Berggren | |
| 6,601,042 | B1 | 7/2003 | Lyden | |
| 6,625,905 | B2 * | 9/2003 | Kita | A43B 13/12 36/25 R |
| 6,826,851 | B2 | 12/2004 | Nelson, Jr. | |
| D507,094 | S | 7/2005 | Lyden | |
| 7,100,308 | B2 | 9/2006 | Aveni | |
| 7,231,728 | B2 | 6/2007 | Darby | |
| 7,681,333 | B2 | 3/2010 | Dardinski et al. | |
| 7,762,008 | B1 | 7/2010 | Clark et al. | |
| 7,793,437 | B2 * | 9/2010 | Chapman | A43B 7/141 36/142 |
| 7,900,376 | B2 | 3/2011 | Rabushka | |
| 8,112,905 | B2 | 2/2012 | Bemis et al. | |
| 8,146,269 | B2 * | 4/2012 | Mueller | A43B 3/0036 36/144 |
| 8,209,883 | B2 | 7/2012 | Lyden | |
| 8,474,154 | B2 | 7/2013 | Werremeyer et al. | |
| 2002/0157279 | A1 * | 10/2002 | Matsuura | A43B 7/00 36/25 R |
| 2006/0117603 | A1 * | 6/2006 | Park | A43B 7/146 36/25 R |
| 2009/0077830 | A1 * | 3/2009 | Lee | A43B 13/10 36/108 |
| 2009/0119949 | A1 * | 5/2009 | Song | A43B 13/146 36/103 |
| 2009/0151201 | A1 * | 6/2009 | Lee | A43B 21/26 36/103 |
| 2009/0183393 | A1 * | 7/2009 | Lee | A43B 13/10 36/103 |
| 2011/0067267 | A1 * | 3/2011 | Lubart | A43B 3/0063 36/88 |
| 2011/0185593 | A1 * | 8/2011 | Ramos | A43B 13/145 36/103 |
| 2012/0198723 | A1 | 8/2012 | Borisov | |
| 2012/0216424 | A1 | 8/2012 | Lyden | |
| 2013/0205619 | A1 | 8/2013 | Hartveld | |
| 2014/0047740 | A1 * | 2/2014 | Tucker | A43B 13/145 36/103 |

* cited by examiner

FOOTWEAR WITH TAPERED HEEL, SUPPORT PLATE, AND IMPACT POINT MEASUREMENT METHODS THEREFORE

CROSS-REFERENCE TO RELATED APPLICATIONS

The present application claims the benefit and priority of Provisional Patent Application Ser. No. 62/136,756, filed Mar. 23, 2015, FOR FOOTWEAR WITH TAPERED HEEL AND ARCH SPRINGS, under 35 U.S.C. §119(e), incorporated herein by reference as if fully reproduced herein.

BACKGROUND OF THE INVENTION

1. Field of the Invention

The present inventive concept relates generally to footwear having a special sole to provide for improved biomechanical operation, including improved foot-plant and together with a support mechanism for enhanced comfort and use.

2. Background Information

There are numerous types and styles of footwear and soles for use with footwear. Some examples of footwear having various sole design and various springing mechanisms include those disclosed in patents such as U.S. Pat. No. 8,209,883, U.S. Pat. No. 7,231,728, U.S. Pat. No. 8,474,154, U.S. Pat. No. 4,128,950, U.S. Patent Application No. 2013/0205619, among others.

While the foregoing products and methods may be beneficial, there is always room for improvement.

SUMMARY OF THE INVENTION

Applicant has recognized the footwear industry today tends to lack knowledge of how the foot biomechanically conforms to surfaces or performs when hiking, running, or walking, or recognizes that the industry simply provides products inadequate in this regard. The midfoot or forefoot are designed or have evolved in such a way that when a foot comes in contact with a surface, flexion of the ankle and plantar mechanism occur and the impact is placed upon the muscle fibers in such a way that provides for efficient relaxation-contraction and allows a powerful stride. Applicant has recognized that when the impact from contacting a surface is placed within the heel area, the plantar and ankle mechanisms are not utilized, or are not optimally utilized. The biomechanical structure of a heel impact forces the knee and hip to absorb the force, or absorb a greater-than-natural force, causing injury. Shoes today are cushioned in the heel and provide only minimal mitigation of the forces absorbed by the body during a heel strike. Without heel cushioning, and over longer distances, the heel impacts will result in painful sensory feedback, and to avoid the discomfort, a person will naturally shift the impact from the heel to the mid to fore-foot. Such heel cushioning over time can cause dramatic injury, particularly with heavier individuals and those who travel far distances. The current footwear with a cushioned heel absorbs enough of the heel impact to bypass the heel's sensory feedback. Over time and distance, the lack of sensory feedback with a cushioned heel impact often result in chronic injury to the plantar mechanism, knees, hips and/or spine.

Applicant has developed a sole believed to minimize strain upon the knees, hips, and spine, and decrease injury and allow natural foot/ankle movement. Biomechanically, an individual's foot is built to walk without shoes. Therefore, the arch and plantar mechanism are designed to act as a spring when the forefoot is loaded on impact. The thicker tissue on the foot demonstrates where a foot should truly contact a surface. The thick tissue padding extends from the posterior part of a foot, down through the lateral side of the foot, across the lateral metatarsals and ends in the forefront of the foot. There is also thicker tissue at the end of each toe. Applicant recognizes the arch region has no such tissue thickening. The heel pad is meant to support static standing for balance, but not meant to absorb the impact associated with a striding motion.

"Barefoot" shoes permit sensory feedback given by the heel, thus decreasing the individual's likelihood of making a heel strike. However the barefoot shoe lacks comfort when contacting the surface because it lacks significant thickness in cushioning at the impact zones of the lateral midfoot-foot and forefoot. Further unrecognized in existing footwear's technology today is the failure to address and promote the biomechanically correct method of running and walking. One aspect of Applicant's invention allows for a rigid plate-like heel which gradually tapers into an adequately cushioned pad at the lateral midfoot area. The plate-like material extends to or through the forefoot/metatarsals while the pad extends to or through to the toes. Applicant refers to the cushioned area at the midfoot area as the "impact zone." In this midfoot area or impact zone is a junction where the tapered heel transitions to a flattened lateral portion at the midfoot. In one aspect a junction line is defined. Impact point or points lie along the junction line, also referred to as the impact line. The junction or junction line is positioned anterior the pivot point of the ankle of a wearer such that the ankle will dorsiflex (i.e., toes point upward), absorb the energy of the foot strike by loading the soleus/gastrocnemius, and then release that energy at the end of the stride. There is limited or no padding between the person's heel and the rigid plate. There is padding between the wearer's midfoot and the rigid plate, with such padding gradually increasing from the posterior aspect of the midfoot to the anterior aspect of the midfoot. The padding may increase because the plate slopes downward from an upper area of the sole to a lower area of the sole. In one example the rigid plate spans substantially or the entirety of the width of the heel and midfoot. In another example the rigid plate spans primarily along the medial aspect of the midfoot while avoiding the lateral aspect. In one aspect a pad or cushioned area lies laterally along the midfoot corresponding to where a foot's natural padding is positioned. In one example the rigid plate extends from the heel through the medial and central midfoot arch. In some aspects the plate has some inherent flex which may provide a springing action. A plate may be made from a variety of materials, including but not limited to carbon fiber.

The plate is configured to support the heel (which heel is suspended posteriorly due to the tapered orientation of the heel, i.e., absence of material positioned below the heel and above the surface) and prevent impact occurring between the arch of the foot and the surface. While the weight or force of the wearer acts upon the plate at the medial and central midfoot arch during a step or stride, the heel is supported/suspended by the rigid plate which extends posteriorly. The rigid plate operates as a spring or dampening force or anti-sag mechanism, storing energy during the early phase of the stride and then releasing it at or toward the end of the stride.

In further method aspects of the invention the pivot point or junction line of the sole is determined based on the physiology of a particular wearer. If the pivot point is positioned posterior to, at or generally near the Pivot Axis of the tibia, a foot plant will most likely tend to not result in a desired dorsiflex of the ankle; and where the impact point is positioned remotely anterior with respect to the Pivot Axis, the wearer will experience a rocking action such that the heel of the shoe or boot will contact the surface when the wearer is standing still under natural balance. As the anteriorly remote pivot point (or junction/impact line) is positioned closer to the Pivot Axis, the tendency of the wearer to rock backward will be reduced. Successive adjustments can be made regarding the positioning of the impact point with respect to the Pivot Axis to determine a preferred position (to the custom fit or desire of the wearer) where the wearer may stand erect comfortably without rocking back and forth which would otherwise occur due to the heel taper. A number of pivot point measuring techniques and associated devices are contemplated within the scope of the present invention.

The above abbreviated summary of the present invention is not intended to describe each illustrated embodiment, aspect, or every implementation or object of the present invention. The figures and detailed description that follow more particularly exemplify these and other embodiments and further aspects of the invention. Other features and advantages of the invention will be apparent from the following description, the accompanying drawings and the appended claims.

BRIEF DESCRIPTION OF THE DRAWINGS

The invention may be more completely understood in consideration of the following description of various embodiments of the invention in connection with the accompanying drawings, in which.

Figure 1:
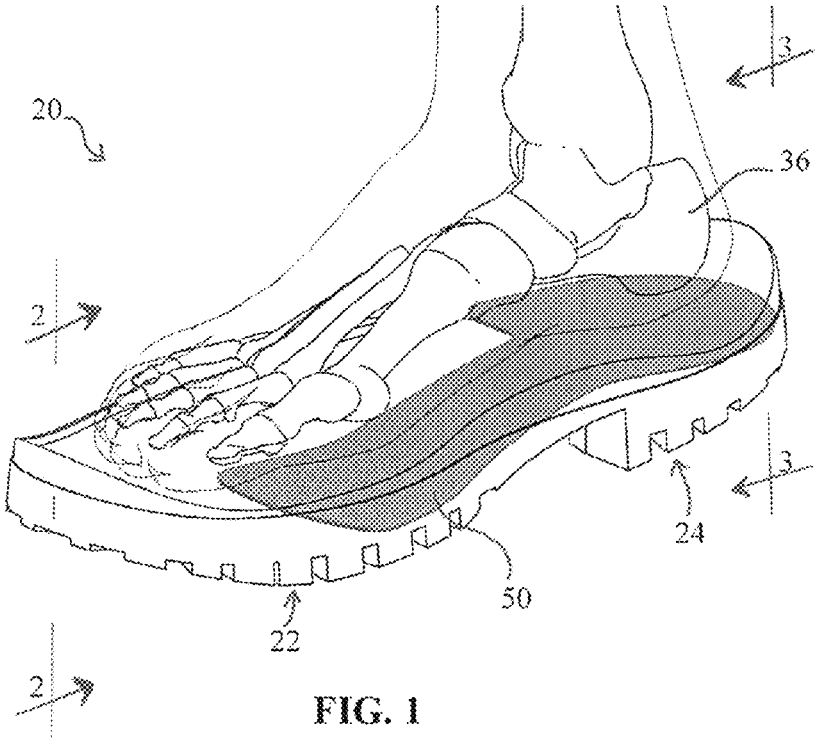
FIG. 1 is a perspective view of an article of footwear in accordance with an aspect of the present invention and presenting a partial skeletal and flesh structure of a right foot for illustration, an upper removed and a component revealed for clarity.

While the invention is amenable to various modifications and alternative forms, specifics thereof have been shown by way of example in the drawings and will be described in detail. It should be understood, however, that the intention is not necessarily to limit the invention to the particular embodiments described. The intention is to cover preferred embodiments, modifications, equivalents, and alternatives falling within the spirit and scope of the invention and as defined by the appended claims.

DETAILED DESCRIPTION OF THE INVENTION

The subject inventive system may take on numerous physical and method embodiments within the spirit of the invention and only preferred embodiments have been described in detail below, which are not meant to limit the scope and/or spirit of the invention.

Human foot bones and structures have inspired the present invention. Aspects of the invention include a tapered/angled heel sole of an article of footwear and a combined heel support mechanism as further shown below.

Applicant appreciates that current footwear fails to address the need for true bio-mechanical movement throughout the foot. The need for a bio-mechanical design to allow proper impact of a foot to a surface is imperative to prevent injuries and fatigue, and to provide comfort for the consumer.

Applicant has come to appreciate that bio-mechanically the midfoot or forefoot are the appropriate sites for impact with running, hiking, or walking, which allows the arch of the foot and the plantar mechanism (muscle/tendon/fascia) to flex on impact in addition to permitting the ankle and the gastrocnemius/soleus muscles to bear a substantial portion of the impact. The flexing of ankle and plantar mechanism during appropriate impact expands the muscle fibers such that they are optimally primed for contraction and a powerful stride.

When the primary impact from a footfall is the heel, the plantar and ankle mechanism are not utilized, hence the knee (and to a lesser extent the hip and spine) must bear the brunt of the force. Bio-mechanically, the motion of the knee and hip during walking and running is not designed to adequately absorb the force from a heel impact. This results in abnormal stress on the entire skeleton from a heel impact. A heel impact also causes stress to the calcaneus and the origin of the plantar tendon. The plantar tendon is designed to bear forces in the parallel plane, not the transverse plane as with a heel strike.

Shoes, which are cushioned in the heel, slightly mitigate the forces with a heel strike, but not substantially. With fewer impacts (short distances) or lighter individuals, a heel strike with padded shoes often will not result in any immediate symptoms. However, heavier individuals or more impacts (longer distances) will often result in pain, which indicates injury.

Heel cushioned shoes also encourage heel strikes by absorbing enough of the impact to bypass the heel's natural sensory feedback. Without a cushioned heel, the calcaneus and the adjacent pad of the heel will start generating a pain signal with repeated impacts. This should modify the stride so that the heel is not taking the impact. The arch and plantar mechanism are bio-mechanically designed to act as springs when the forefoot is loaded on impact, but not to take an impact force from the plantar direction. The positioning of thicker "padded" subcutaneous tissue illustrates exactly where a person's feet are supposed to contact the ground. This thicker tissue "padding" extends from the heel, down the lateral aspect of the foot, across the metatarsal heads with small pads at the ends of the toes. The arch region has no such tissue thickening. Current footwear has an impact surface area that extends across the midfoot and often directs that force into the arch through "arch support". These types of abnormal forces often in conjunction with a heel strike placing a similar plantar force on the origin of the plantar tendon from the calcaneous highly likely contribute to plantar tendon, muscle, and fascial injuries.

"Barefoot" shoes with little or no padding throughout the entire foot have helped alleviate the problem of heel striking by making sure the sensory feedback loop from the heel is not mitigated. However, such "barefoot" shoes do not provide adequate padding at the midfoot or forefoot which is appropriately bearing the substantial impact. This makes the shoes/boots or other similar footwear seem less comfortable, which inherently decreases the likelihood of people using or buying them. Additionally, the lack of padding does increase the transmission of heat from the ground (hot feet) and the risk of developing a stress injury to the midfoot or forefoot, particularly in individuals who are not accustomed or habituated to the bio-mechanically correct method of walking and running.

Current footwear addresses the need for additional cushioning throughout the foot to provide comfort on an impact, and in other inventions, a spring like mechanism to absorb shock. While current designs allow the foot to absorb minor heel impacts without causing stress to the body's calcaneus and plantar tendon, they do not address the fact that a foot is not designed to impact a surface with an individual's heel. The current invention, however, is bio-mechanically correct as it persuades the foot to contact the surface through lateral midfoot and fore-foot areas in order to prevent injury, particularly to the plantar mechanism, knees, hips, and spine.

Figure 2:
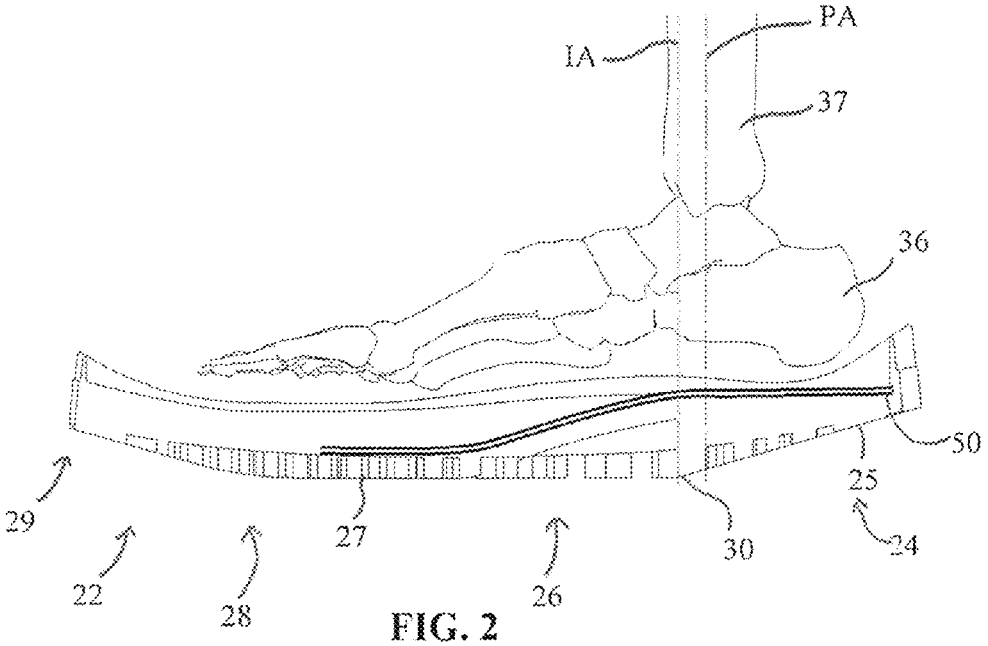
FIG. 2 is a section view taken along line 2-2 of FIG. 1.

Referring to FIGS. 1-14, various aspects of the invention are shown. FIG. 1 depicts one example of a footwear article 20 of the invention which may include a shoe or boot or other article of footwear. FIG. 1 is a perspective view of a portion of footwear article 20 with an upper removed for clarity and illustrating flesh and skeletal structure of an ankle of a wearer. For clarity, FIG. 1 also reveals a plate aspect of the invention discussed below. Footwear article 20 may include upper 21 (See FIG. 13) such as an upper of a shoe or boot or other type of footwear upper which may include a leather, rubber, fabric, plastic, synthetic or other component and is configured to receive a foot of a wearer. Upper 21 is connected to sole 22. Footwear 20 includes a sole 22 having a tapered heel 24. Heel 24 leads to midfoot 26 which leads to forefoot 28. Toe 29 extends from forefoot 28. Sole 22 includes a junction line 30 also known as an impact line 30. In one aspect junction line 30 delineates the transition from tapered heel 24 to midfoot 26. As shown in FIG. 2, heel 24 is tapered or angled with respect to midfoot 26. In one aspect a heel line 25 is angled with respect to midfoot line 27. The forefoot 28 is shown angled with respect to the midfoot 26 up to the toe 29; however, this is not required. For example, a substantially flat midfoot surface may extend fully to the toe 29. Thinning of the sole in the region of the toe 29 may allow that region to more readily flex without detrimental toe impact.

Figure 3:
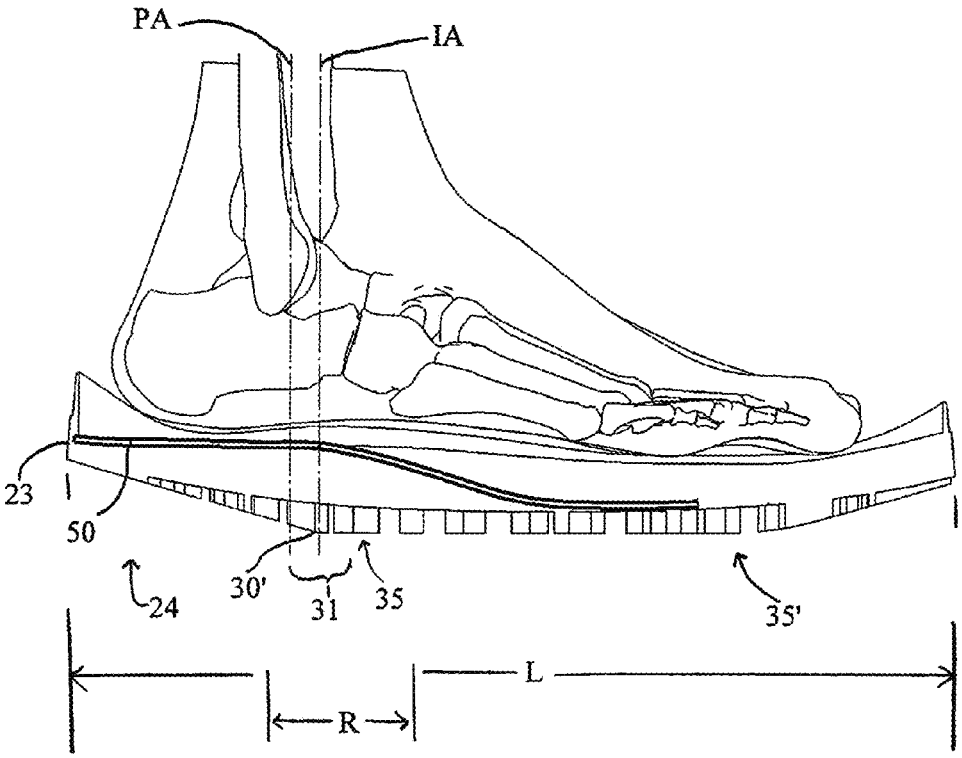
FIG. 3 is a section view taken along line 3-3 of FIG. 1.

Impact point 30' or points 30' lie along and/or form impact line 30. Impact line 30, and associated impact point or points 30', is located anterior to the ankle Pivot Axis (PA) as shown in FIG. 2 and FIG. 3. In some aspects impact line 30 may span generally the width of sole 22. The impact line 30 demarcates the end of tapered heel 24. This transition, while characterized as a "line" 30, does not have to be precisely linear so long as the structure functions, as hereinafter described. That is, the midfoot 26 and heel 24 do not have to meet at a straight line. Different shapes and materials might be used to allow the controlled desired movement of the heel 24 relative to the midfoot 26, as with respect to a reference line.

Figure 5:
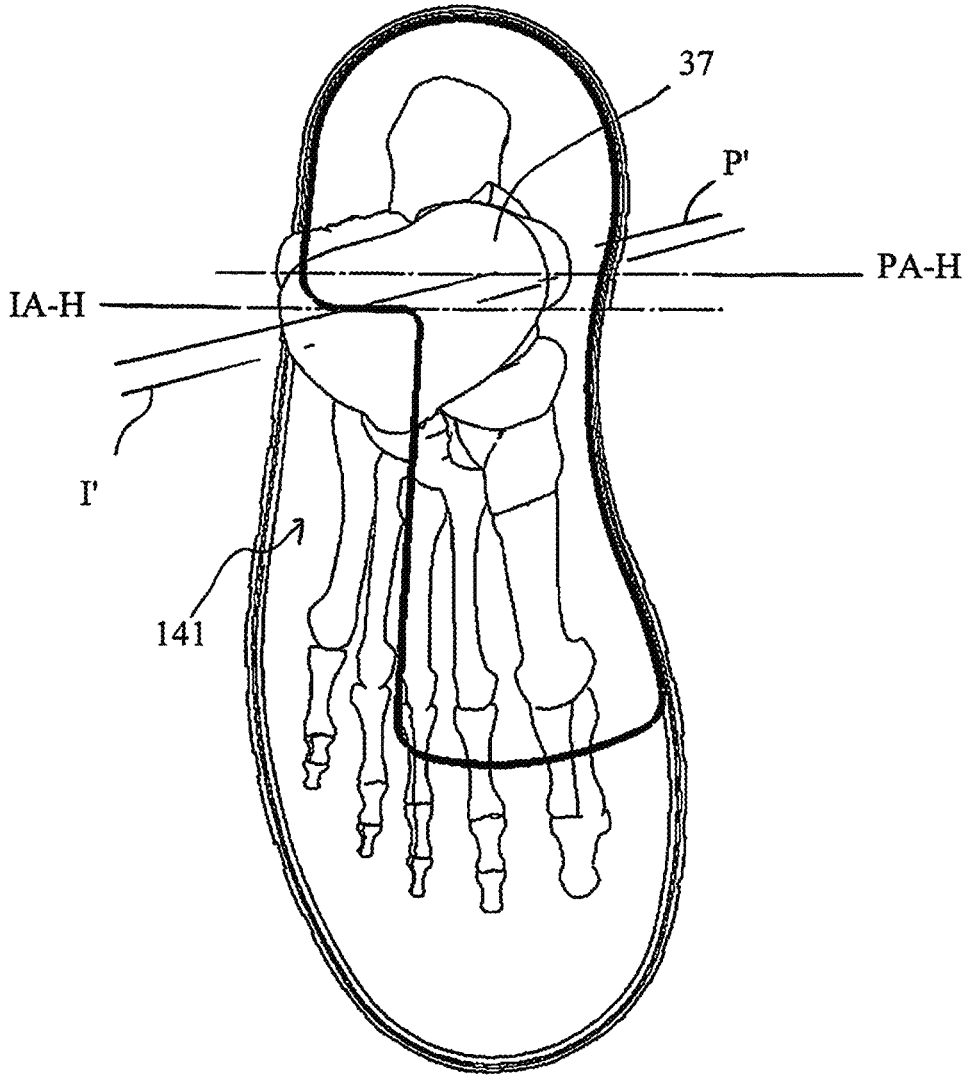
FIG. 5 is a top view of the article of FIG. 1.

The Pivot Axis PA is a central vertical axis of the tibial-talar joint, or recognizing the human body includes loose or floating joint aspects, the Pivot Axis PA is a vertical axis demarcating a general line of rotation of the ankle joint in a dorsiflex motion of the foot. The Pivot Axis PA is shown or measured perpendicularly to the surface upon which sole 22 rests. While recognizing that it may or may not always coincide with the actual or perfect positioning of the true axis of the joint, for the purposes of ascertaining an objective reference point without directly testing a particular wearer, the central axis of the tibia may be used here as the axis coinciding with the pivot axis of the ankle. The true Pivot Axis PA and/or PA-H of a person may be measured with reasonable certainty as shown below. As shown in FIG. 5, horizontal Pivot Axis PA-H aligns with a central area of tibia 37 (and intersects with Pivot Axis PA) and represents an axis about which a person's foot dorsiflexes or rotates upward/downward. The horizontal Pivot Axis PA-H shown in FIG. 5 represents an axis of perpendicular alignment with respect to sole 22.

Impact line 30 is situated on Impact Axis IA. Impact Axis IA is parallel to and offset anteriorly from Pivot Axis PA. In this aspect impact line 30 is oriented perpendicular with respect to sole 22. As shown in FIG. 5, the impact axis may be skewed or tiled at an angle as shown by axis P', with a corresponding alteration of impact axis as shown by axis I'. It may be appreciated that where an impact line 30 is configured as a straight line, the ankle joint will tend to flex or rotate along or about the impact line 30. Thus, the plant angle of the ankle/foot may be influenced by tilting the slope of the impact line 30. For instance, an impact line 30 which is oriented along the impact axis I' will tend to cause a foot plant where the toes point inward during the step or stride; whereas, if the impact line 30 is sloped an opposite direction, the foot will tend to plant such that the toes are directed outward from the body. Altering the slope of the impact line 30 therefore allows for rehabilitation of or accommodation to fit a wearer's foot plant or stride. Such variations may relieve (or accentuate) stresses at the knees or other skeletal structures of a wearer.

As shown in FIG. 3, Impact Axis IA is situated anterior Pivot Axis PA. It may be appreciated that positioning impact axis IA anterior to Pivot Axis causes the ankle to dorsiflex, i.e., the front of the foot will tend to lift or flex upward.

Figure 4:
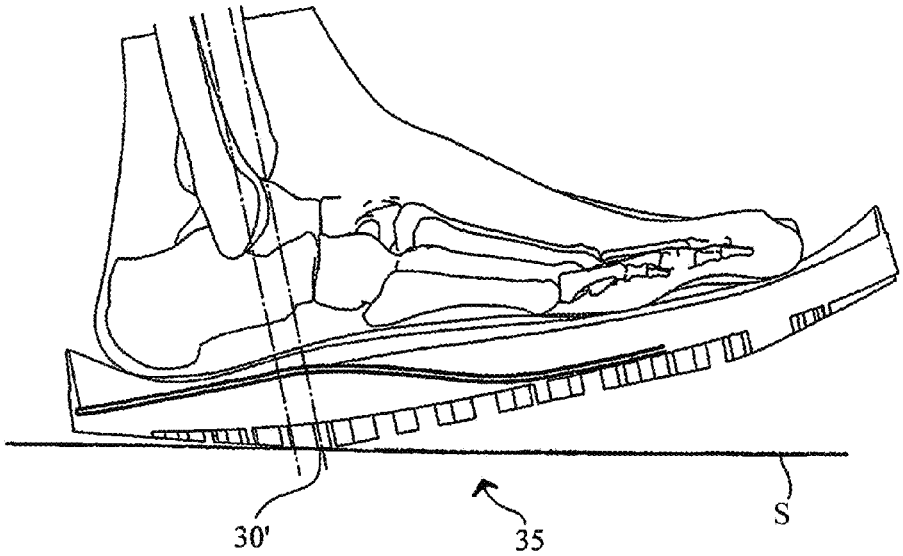
FIG. 4 is a further view of the article of FIG. 3.

FIG. 4 depicts sole 22 in a walking or running motion just as sole 22 is striking the surface S in one representative stride. As shown in this example the heel 24 is not in contact with surface S and the impact forces are received at least in part at impact point 30' and/or along impact line 30. Because impact point 30' is situated anterior pivot axis PA, a natural mechanical action causes or tends to cause the ankle to flex, thus engaging the gastrocnemius or other muscles of the leg as desired. If the impact axis were positioned even further anteriorly from pivot axis PA, the mechanical advantage of the flexing forces would be even greater for a more dramatic flex of the ankle; whereas the opposite would be the case if the impact axis IA were positioned closer to the pivot axis PA. At some point where the impact axis IA approaches the pivot axis PA (or even where the impact axis IA is posterior the pivot axis PA, such as perhaps where there is a severe heel taper), the mechanical flex of the ankle will be minimal or nonexistent.

As shown in FIG. 3, due to the flexibilities of the human ankle and given different preferences, the impact point 30' and impact line 30 may be situated at impact line region 31 and still produce a desired flex as described. At some distance beyond region 31, the flex action will still be present (even accentuated), yet the sole will rock or tip backwards or the user will feel a tendency to tip backwards when standing with the midfoot for positioned on a flat surface S. It may also be appreciated that wearers have varying skeletal foot structures, even those pertaining to feet that may fit in the same size shoe or boot. For instance, some wearers may have a longer (or shorter) calcaneus 36, or longer (or shorter) toes, or other variations of skeletal and flesh features. The pivot axis PA of one person wearing foot article 20 may be different as compared to the pivot axis PA of another person wearing the same article 20. Accordingly, as the pivot axis PA varies, so does or so can the impact axis IA. Depending on skeletal structure, the impact point 30' may be configured within impact line range R. Impact line range R is between 18-32 percent of the length L of sole 22. For instance, impact point 30' may be situated anteriorly from posterior end 23, 18% of the length L of sole 22 (with a corresponding alteration to the tapered heel 24). In another example, impact point 30' may be situated 32% of length L from end 23. A more typical skeletal structure includes an example where the impact line range R is between 20 and 30 percent, and even more typically, impact point 30' is positioned from end 23 about 25% of length L. The length of midfoot 26 as shown in FIG. 3 is about 50% of the length L, where the fore foot is shown with a slight toe rise. Depending on manufacture and performance desire, the length of midfoot 26 ranges from at least 25% of the length L or greater. With midfoot 26 lengths of less than 40 percent of length L, the thickness of sole 22 will become awkward or unworkable for manufacture and/or use. For instance, if the length of midfoot 26 were 30% (with the tapered heel 24 and slightly rising forefoot/toes 28 comprising the balance of the length L), the sole 22 would be thick and require different padding considerations, different slopes of plate 50 configurations, added height to the article 20 with corresponding balance considerations and potential tipping or rocking troubles. FIG. 3 also shows the inserted foot as positioned at (or substantially at) a flat orientation (as opposed to having a dramatic slope from heel to toe or toe to heel). The wearer will feel comfortable with such flat or relatively flat configuration, especially when standing still.

"Impact zone" 35 is where footwear 20 at the lateral aspect of the sole 22 is the first portion of sole 22 to impact a surface S when a user is walking and/or hiking. Such impact zone is oriented about the lateral aspect of the midfoot 26. The junction area or impact area is positioned slightly anterior to the ankle. The mechanics of an impact in this region cause the ankle to flex and absorb some of the force. The 4th and 5th metatarsals will also flex as the impact rolls towards the forefoot 28 with a forward stride and further flexing the ankle and lengthening the Achilles/gastrocnemius (calf). This process of increasing flexion at the ankle loads the calf for a more powerful extension and push off at the end of the stride (providing an extra "kick").

The "impact zone" 35' in the case of when a person is running is at the forefoot 28. This allows the calf muscle to absorb more of the initial force (which is greater during running) and permit a high cadence. Additional power will be generated by the calf resulting in greater speed and/or more endurance as the work load is distributed to more muscles. A forefoot strike will also allow the foot arch/plantar mechanism to be fully utilized as it stretches/flattens on initial impact and then contracts/arches at the end of the stride.

Figure 6:
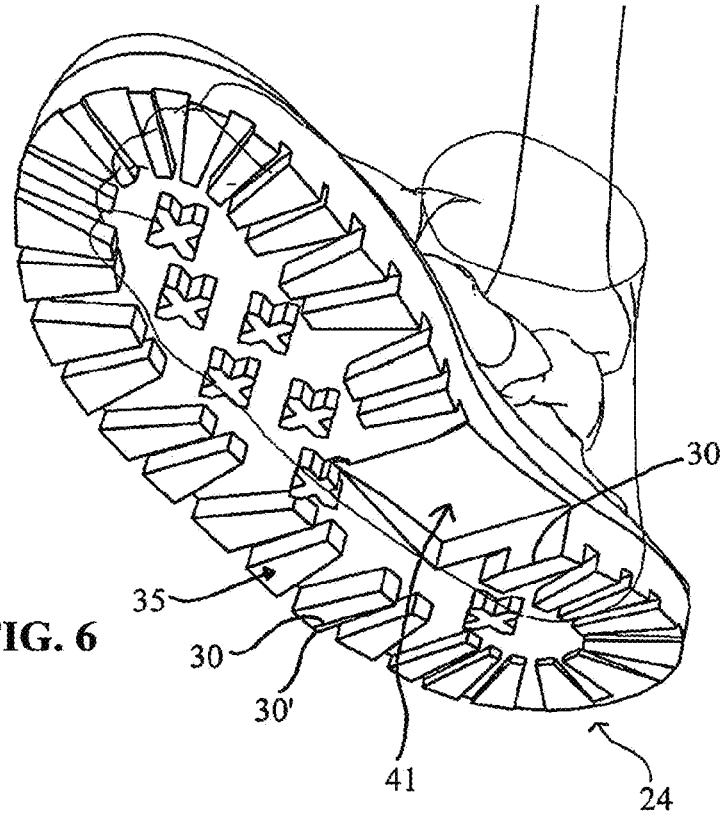
FIG. 6 is a bottom perspective view of the article of FIG. 1.
Figure 7:
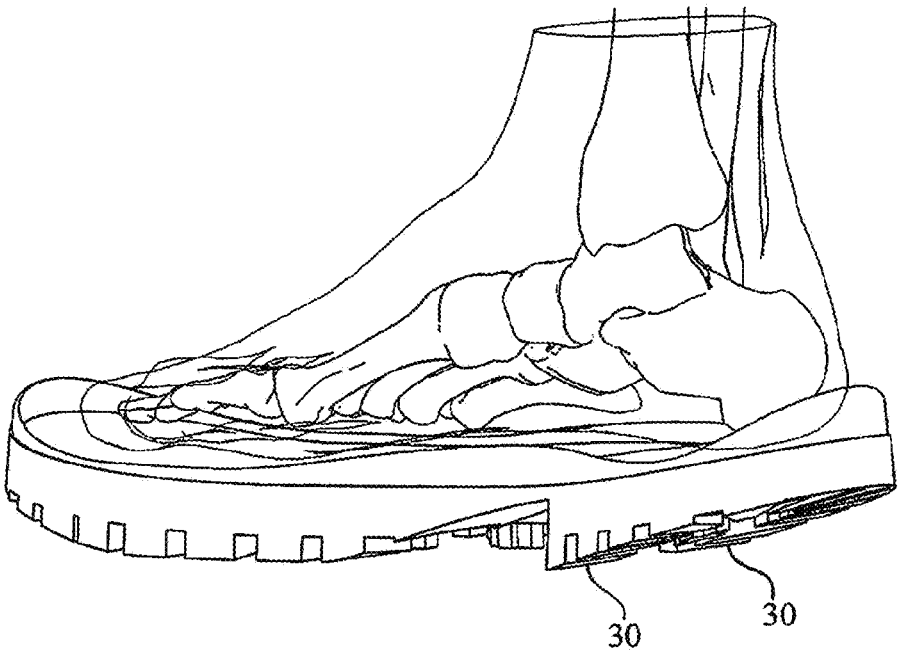
FIG. 7 is a perspective view of the article of FIG. 1.
Figure 8:
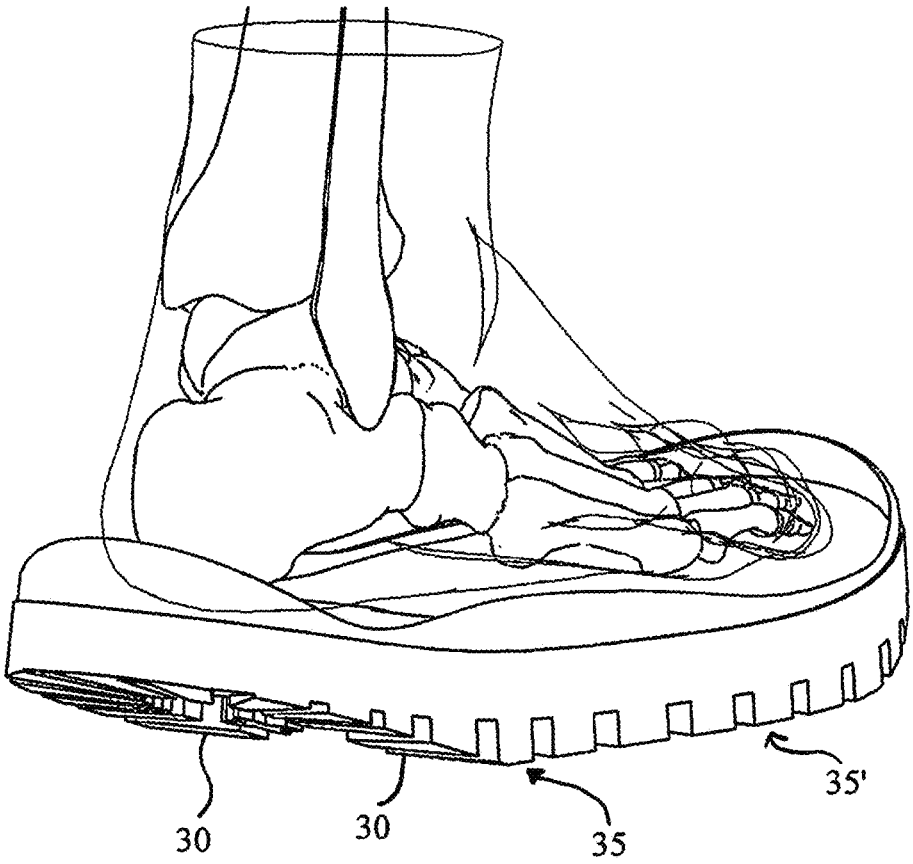
FIG. 8 is a perspective view of the article of FIG. 1.
Figure 9:
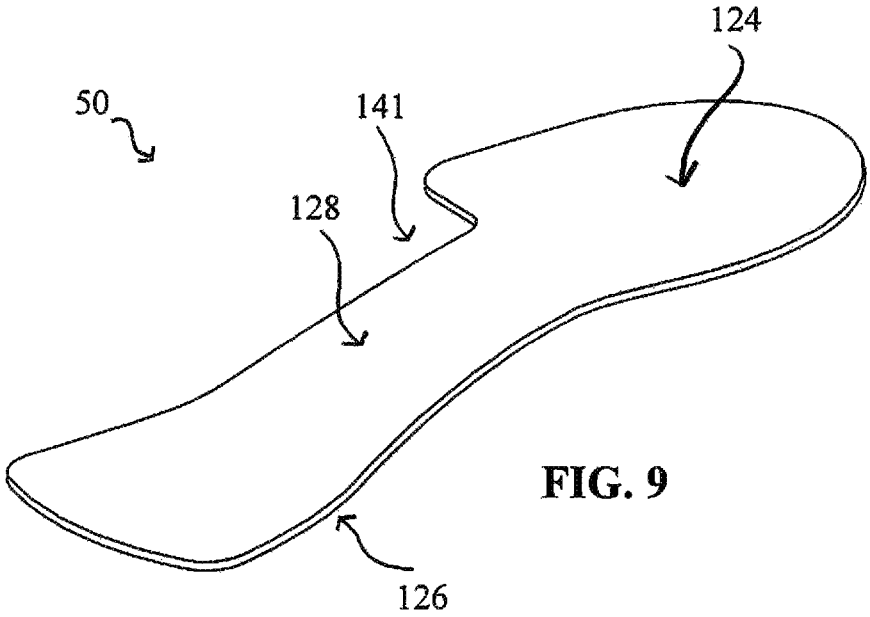
FIG. 9 is a perspective view of a component in accordance with a further aspect of the present invention.
Figure 10:
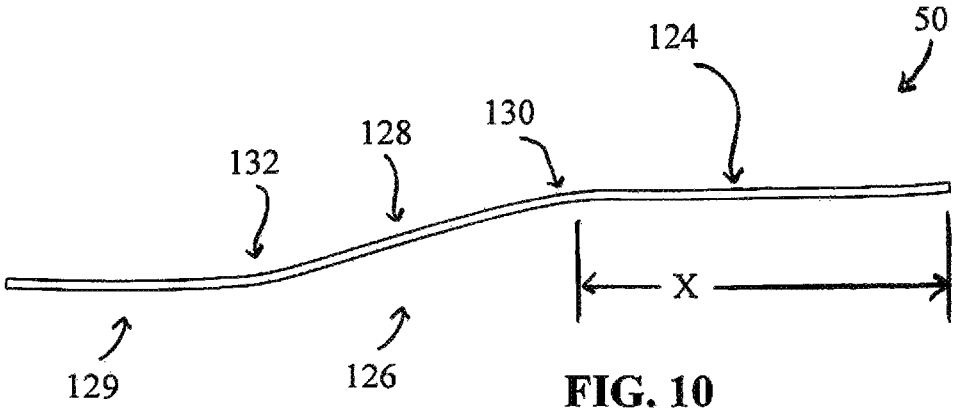
FIG. 10 is a side view of the article of FIG. 9.
Figure 11:
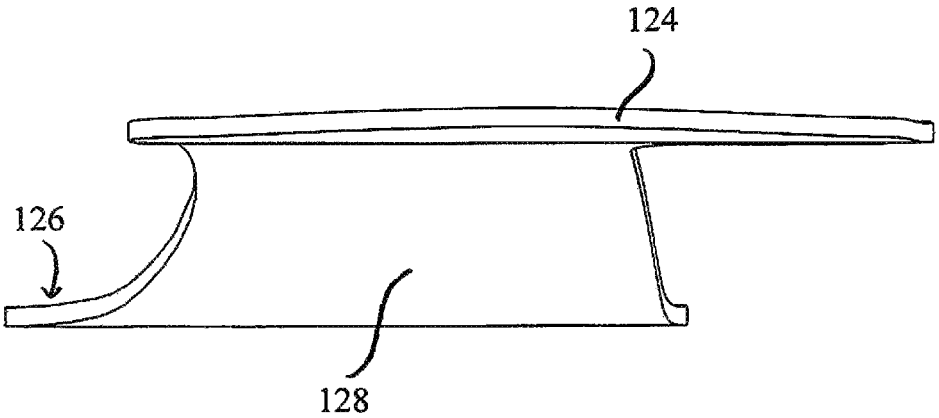
FIG. 11 is a rear view of the article of FIG. 9.

As shown in FIGS. 6-8, sole 22 defines a void 41. Particularly, void 41 is defined at least in part by an underside of sole 22 at a medial area of the sole and by heel 24 and by a lateral aspect of the sole 22. Because void 41 contains no material, such area is protected from direct force impact during a stride, which emphasizes the desire and function of a lateral side impact. In alternatives, void 41 may be filed with material or materials may extend into void 41, however the emphasis of initial impact will still be at the lateral side and in assuring a properly positioned impact point 30' or impact line 30. FIG. 7 and FIG. 8 show different view of sole 22 and illustrate the positioning of impact line 30 or impact lines 30.

In one aspect, sole 22 provides no or minimal cushioning in the region of the heel 24 and medial midfoot 26 (arch). In other aspects the sole 22 includes no cushioning at the heel 24 and the medial midfoot 26.

Orientation of heel line 25 to span in a generally straight line from posterior 23 to impact line 30 accommodates a natural midfoot contact area. For instance, having a heel 24 which tapers from posterior 23 to impact line 30 of midfoot 26 encourages a walker or hiker to make initial contact with the surface at area 30. With traditional walking or hiking footwear, the heel of the sole includes material such that the heel area tends to strike the surface first, or before the striking of the midfoot. Having a clipped heel or having a heel 24 taper from posterior 23 to midfoot 26 promotes a desired strike at the midfoot 26. Applicant believes such midfoot strike promotes improved bio-mechanical operation of the foot and ankle. In one aspect heel line 25 of heel 24 tapers to a position anterior to the ankle of the wearer. In the example of FIG. 3 the heel line 25 tapers to the impact line 30 at the beginning of midfoot 26. In this example, midfoot 26 continues in a flat or horizontal configuration. All sole regions that contact the surface S, while nominally flat and shown as flat, could be slightly contoured. For example, they may be curved concavely or convexly. In a further aspect, sole 22 may also be slightly rounded at the location of impact line 30. It may be appreciated that sole 22 has a thickness which increases from the posterior 23 to impact line 30.

The sole 22 embodying principles of the invention consists of adequate cushioning across the entire forefoot. This cushioning increases for extra padding over the 4th and 5th Tarsal-Metatarsal joints, and in particular, the 4th and 5th Metatarsals, in addition to the Metatarsal-phalangeal joints. In one aspect the cushioning consists of a top layer which is made of a compressible material. Underneath the top compressible layer, several firmer layers help support the impact of a surface hit to the foot. These layers can be customized to a person's weight in order to perform optimally.

The inventor appreciates the foot is made to take impact to a surface through the lateral midfoot-foot and into the forefoot. The impact zone of the sole of the present invention is designed so the foot receives such impact. Similar to a walking/hiking foot strike, when running, the foot utilizes the spring mechanism when it is stretched and flattened upon a surface contact and then contracts within the arch as the foot comes to the finish of the stride. Over time it is expected that a user will begin to develop a modified and appropriate stride and foot strike. Through even short-term use a user is expected to have or develop muscle memory that repeats the desired action of impacting the midfoot-foot and/or forefoot instead of the heel area.

While the sole 22 is shown of various configurations, it may be appreciated that the sole 22 may correspond to either or both a left or right foot orientation.

In a further aspect the invention includes sole 22 with plate 50. As shown in FIGS. 1-4, plate 50 is contained within sole 22, or at least partially contained within sole 22. In one aspect the entirety of plate 50 may be encased within sole 22. In other aspects, a portion of plate 50 may extend from or may be exposed from sole 22. Plate 50 is a rigid plate or semi rigid plate. Plate 50 may be made from carbon fiber or another material, such as a metal, a plastic, a composite, etc. As shown in FIG. 2, plate 50 extends from heel 24 and through midfoot 26 and, in a preferred form, terminates adjacent the end of the midfoot area and before toe 29. The plate 50 could extend to the toe 29. With reference to FIGS. 1-5 and 9-11, plate 50 includes a plate heel 124, a plate midfoot 126 and a plate slope 128 positioned between plate heel 124 and plate forefoot 129. Plate heel 124 is flat or generally flat. Plate forefoot 129 is flat or generally flat. Plate heel 124 transitions to plate slope 128 at inflection area 130. Plate slope 128 transitions to plate forefoot 129 at inflection area 132. The plate slope 128 may be generally flat or arched, or otherwise contoured between the inflection areas 130, 132. The radius or curvature at inflection areas 130, 132 may be adjusted as desired. A relatively sharp transition at the inflection areas 130, 132 is also contemplated at different angles. The inflection area 130 begins a distance "X" from a terminal end of plate heel 124. The length of distance X may vary to accommodate placement or configuration of plate 50 within sole 22 to coincide with the structures of sole 22 addressed above. For instance, inflection area 130 may begin at a length X coinciding with a pivot axis PA and/or impact axis IA (or at some other location) as desired. The length X of plate heel 124 may be configured to match the natural skeletal structure of a user. In some aspects plate heel 124 may include a slight cup attribute.

As shown in FIG. 2, plate heel 124 is positioned proximal to a top surface of heel 24, and in some instances may be exposed and/or covered with a material, that may define a relatively thin layer. This allows for a wearer's heel to feel the sensations of a foot plant and assist in teaching muscle memory for achieving a proper foot plant. Because heel 24 is tapered, there is minimal or no direct contact of sole 22 at heel 24 with the surface S and thus minimal or no (or reduced) direct force applied to a wearer's heel upon a foot plant or stride. Plate 50 at slope 128 is covered with material such as padding which thickens as slope 128 extends anteriorly. Such thickened padding accommodates a foot plant at a lateral aspect of the midfoot 26 and especially at the impact zone 35'. Plate forefoot 129 is positioned proximal to a bottom surface of sole 22 which allows for a relatively thick overlay of padding. Posteriorly thereof, the plate 50 provides a changing degree of vertical support. To enhance the lateral aspect and encourage a proper foot plant, plate 50 defines a lateral void 141, which is an area in part defining impact zone 35, 35'. Absence of plate 50 at impact zone 35, 35' minimizes hard force impact at the lateral aspect of a foot. Plate heel 124 is also oriented such that a terminal end of plate heel 124 lies closer to heel line 25 as compared to plate 50 at inflection area 130. While heel 24 may taper, plate heel is flat or generally flat. In one aspect plate 50 is positioned within sole 22 such that heel plate 124 is oriented horizontally. Plate heel 124 may also be tipped as desired for alternative performance.

As shown in FIG. 2, plate heel 124 suspends rearward from impact line 30. Because heel 24 is tapered, heel 24 might otherwise have a tendency to sag. Over time, the taper aspect of heel 24 would be modified and the desired ankle flex as noted herein would be compromised or lost. When a wearer stands in the footwear article 20, the user places weight on the sole at midfoot and forefoot (in addition to placing weight at heel 24). Typically a person will balance by maintaining a slight forward lean or a slight forward angling of the tibia 37 (or shift of body weight to be slightly forward of center body weight for controlled balance, i.e., people subconsciously maintain a slight forward-oriented balance when standing upright and/or when walking). Such forward weight balance allows a user to impart force at the midfoot 26 and forefoot 28 while utilizing plate 50 to extend rearward to support plate heel 124 and thus support, at least in part, a wearer's backwards lean. Such support of the plate heel 124 reduces the tendency of sole 22 to rock or tip backwards (i.e., which would tend to cause tapered heel 24 to touch surface S). Because impact point 30' is oriented anterior to the pivot axis PA and/or PA-H, such back leaning tendency is increased; yet plate 50 accommodates a counter balance to such tip or rocking tendency.

Figure 12:
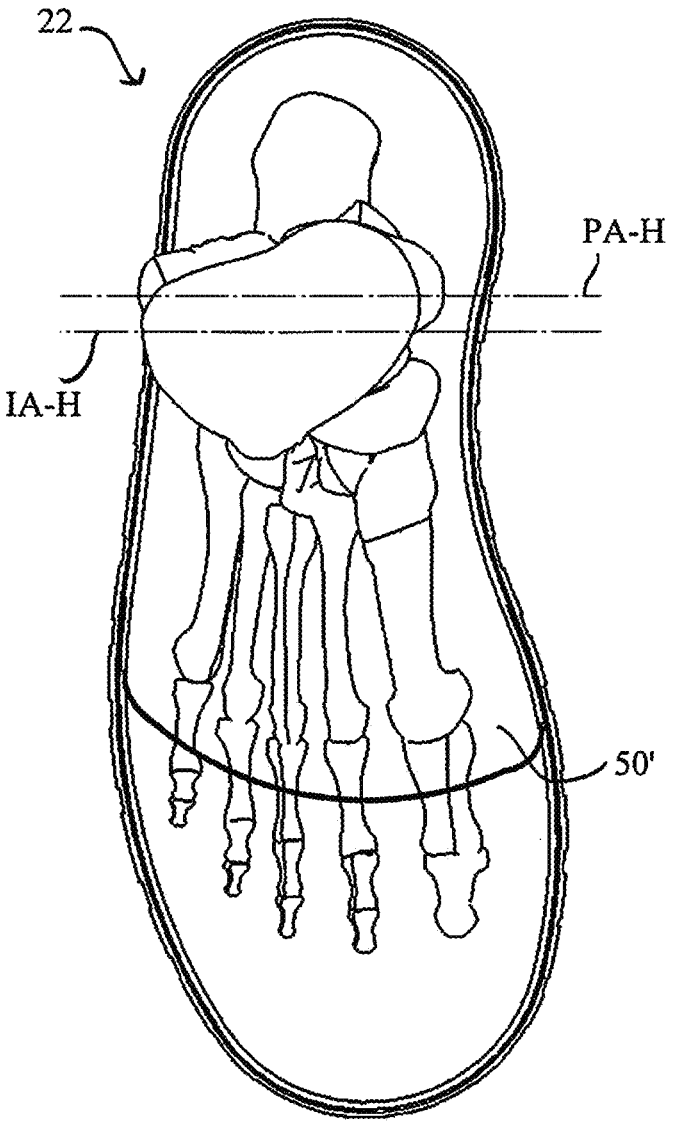
FIG. 12 is a top view of the article of the present invention with portions removed for clarity.

FIG. 12 shows an alternative plate 50' and sole 22. Plate 50' in this aspect does not define a lateral void 142 but includes plate material at the lateral aspect of sole 22. From this view and that of FIG. 5 it may be appreciated that plate 50, 50' terminates before reaching the toes so that the toes can flex unimpeded by the plate 50'.

The plate configuration may vary significantly from that in the exemplary embodiments 50, 50'. The plate generally provides a cantilevered support for the heel 24 to maintain heel shape and adequately bear wearer weight that might otherwise cause backward leaning that could bring the heel into contact with the surface S. Any configuration that will accomplish this is contemplated.

For example, the plate does not need to extend anteriorly to adjacent the toes and could extend to a considerably lesser extent along the midfoot portion so long as the plate is effectively anchored and provides the necessary support for the heel portion. This will generally require a degree of extension anteriorly into the midfoot portion so that the cantilevered heel portion will be adequately stabilized vertically relative to the midfoot portion. The degree of heel support is controlled principally by selecting the appropriate rigidity of the support material and the sole material under the plate anteriorly of the plate heel and against which the plate bears under the user's weight applied at the plate heel.

The plate may have areal sizes and shapes, as viewed from the top of the sole, that are different than those depicted over the plate heel and/or plate midfoot. For example, the plate may be designed primarily to support the plate heel. Alternatively, the plate may be designed primarily to reinforce the sole material, anteriorly of the heel, as against twisting or the like. Appropriate shapes would be selected for these purposes.

The plate can have a uniform thickness or may have strategically thickened regions. In the former case, it could be formed from a single piece of sheet material.

Figure 13:
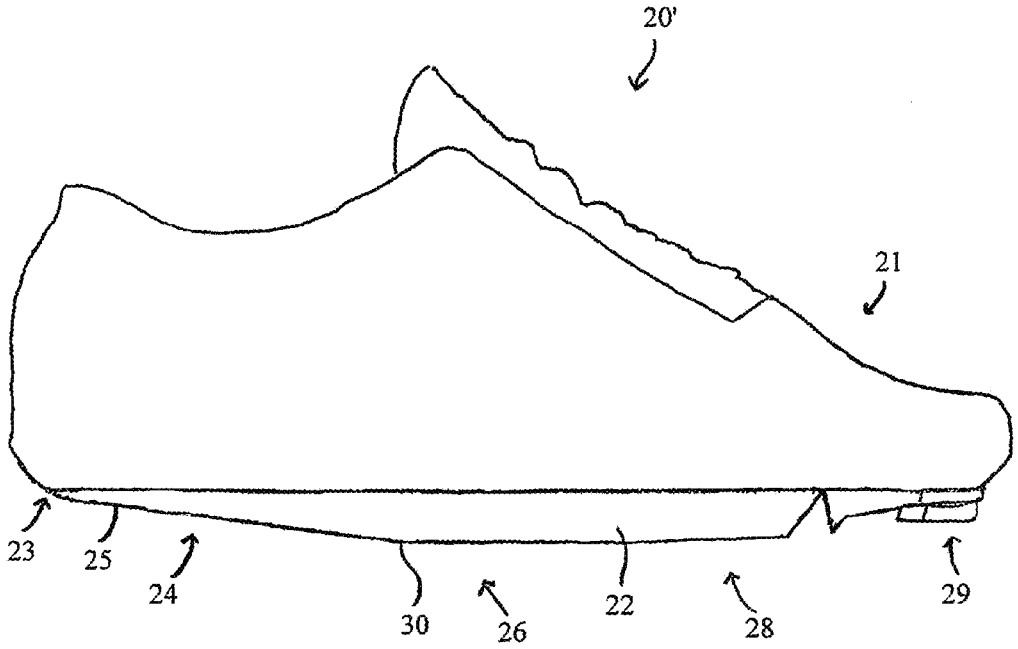
FIG. 13 is an elevation view of or a further aspect of the present invention.
Figure 14:
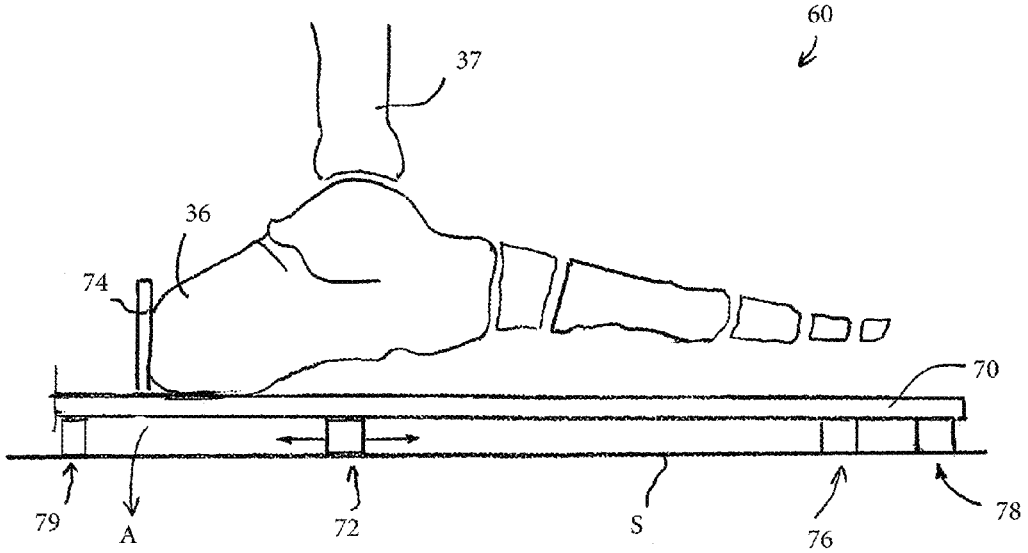
FIG. 14 is a side view of a footwear article in accordance with a further aspect of the present invention.

FIG. 13 shows an alternative article 20' including an upper 21. It may be appreciated that the plate 50, 50' may be contained within article 20'. A variety of different uppers 21 may be used in conjunction with sole 20. Sole 22 may be equipped with a variety of different plates 50, 50'.

In a further aspect, the invention includes a method of customizing a footwear article 20 and/or a sole 22 to a particular user. A person may have his or her feet scanned (digitally, for instance) with the data stored and used to create parts and component parts of article 20 or sole 22. In one aspect a scan will be conducted to determine the pivot axis PA and desired impact axis IA of a user. The profile of the user will be used to create a custom made heel layer (having a plate option) conform to the particular user profile.

The various other components of the sole 22 may likewise be custom made or custom selected and assembled to create article 20. In a further aspect, a 3-D or additive printing may be utilized to create the particular components.

In a further method aspect of the invention, the pivot point 30' or junction or pivot line 30 is determined based on the physiology of a particular wearer. In one aspect with respect to FIG. 14, a measuring apparatus 60 includes a tipping board 70 configured to allow a wearer to stand on the board 70 and maintain a balance while standing. A fulcrum 72 is provided (and selectively slid or slidable, shown generally by arrows associated with fulcrum 72) to adjust the tipping or leverage characteristics of board 70. Board 70 may be calibrated before use, and in one instance is pre-positioned to a distance of 27% of the total foot length from the heel (from a posterior backstop 74 associated with board 70). The 27% is used as a common position for a balance point (i.e., a typical pivot axis PA). The total length of the wearer's foot is measured (on or off board 70). The fulcrum 72 is slide forward or backward from the preset point until a least amount of combined pressure on the heels and toes of the wearer is achieved to avoid a forward or backward tipping. The fulcrum position at this event is noted and used as the pivot axis PA (i.e., the position where the ankle pivots most naturally. It may be appreciated that this pivot axis need not be the central vertical axis of the tibia.

The impact point 30' and/or impact axis IA is then determined. In one aspect, an anterior support 76 is provided under plate 70 to assure plate 70 is flat. Beginning at the previously determined ankle pivot point (pivot axis PA), fulcrum 72 is gradually moved forward until the wearer tips the plate 70 backward in the direction of Arrow A. Plate 70 may contact the surface S. The location of the fulcrum 72 is noted which corresponds to a tip back point, or impact point 30' or impact axis IA. Of course, the impact point 30' (and impact line 30, and the skew or orientation of the line 30) may be altered to accommodate more aggressive use and/or for rehabilitation or training purposes (i.e., where the wearer might not always be comfortable but in order to achieve a training or rehabilitative result). The fulcrum 72 may be moved between the ankle pivot point and the tip-back point (i.e., to define a corresponding pivot axis PA, PA-R and desired impact point 30') until the wearer finds the most comfortable position. An anterior support element 76 is or may be provided, at least temporarily, while locating the tip-back point. A pressure gauge or gauges 78, 79 may also be utilized as desired to determine pressures/forces and record readings. The pressure gauges 78,79 may assist in determining if there is a least amount of combined pressure on the heels and toes). Low resistance stops may also be used to inhibit the forward and backward movement of plate 70 so that a person may step on plate 70 without severe tipping. An adjustable counterweight may also be used to balance plate 70 prior to the wearer stepping on plate 70. The wearer may place both feet (or one foot) on board 70 while standing to determine the desired ankle pivot and/or impact point 30'.

A further aspect includes manufacture and/or selection of a sole 22 (and or plate 50, 50', and or article 20, 20') utilizing the impact point data determined in the step or steps noted herein. An aspect of such manufacture and/or selection includes configuring the tapered heel 24 and/or positioning the plate 50 to accommodate a desired ankle flex as noted herein.

The foregoing relates to exemplary embodiments of the invention and modifications may be made without departing from the spirit and scope of the invention as set forth in the following claims. The scope of this invention also includes embodiments having different combinations of features and embodiments that do not include all of the above described features.

What is claimed is:

1. A shoe or boot comprising:

a sole and an upper, said sole having a plate which spans substantially a full width of said sole at a heel and spans a partial width of said sole at a midfoot, said plate defining a lateral void, said sole including padding positioned at the lateral void, said shoe or boot further comprising padding positioned above said plate and having a thickness which increases from a posterior to an anterior of said midfoot, said sole having a posterior-most aspect in contact with a surface with the shoe or boot resting naturally upon the surface, said plate rigidly integrated within said sole and having a plate heel extending posteriorly of the posterior-most aspect.

2. The shoe or boot of claim 1 where said plate heel is positioned at or adjacent an upper surface of said sole, said plate having a plate forefoot positioned closer to a lower surface of said sole than the upper surface of said sole.

3. The shoe or boot of claim 1 where said sole includes a tapered heel defining a heel line, said plate having a plate heel oriented generally parallel to the surface, said heel line angled with respect to said plate heel.

4. The shoe or boot of claim 1 where said sole includes an impact point positioned anterior a pivot point associated with an ankle of a foot inserted into said shoe or boot, said impact point being a posterior-most aspect of said sole in contact with a surface when said shoe or boot rests naturally upon the surface.

5. The shoe or boot of claim 1 wherein said plate is encased within said sole.

6. The shoe or boot of claim 1 wherein said plate includes a plate slope positioned between a plate heel and a plate forefoot, said plate slope slopes downward from said plate heel and extends longitudinally substantially an entirety of said midfoot of said sole.

7. The shoe or boot of claim 1 where said plate includes a plate slope which spans from said heel to adjacent a forefoot of said sole.

8. The shoe or boot of claim 1 where said plate includes a plate slope between said plate heel and a plate forefoot, said plate slope extends longitudinally at least one fifth of a total length of said sole.

9. The shoe or boot of claim 1 where said plate includes a plate slope, at least a portion of said plate slope is oriented half way between a heel end and a toe end of said sole.

10. The shoe or boot of claim 1 where said plate includes a plate slope extending longitudinally about one third of a total length of said plate.

11. A shoe or boot comprising:

a sole and an upper, said sole comprising:

an impact line being a posterior-most aspect of said sole in contact with a surface when said shoe or boot rests naturally upon the surface, said impact line defining an impact axis; and a plate having a plate heel, a plate slope and a plate forefoot, said plate slope sloping downward from said plate heel at an inflection area, said inflection area positioned at or adjacent said impact axis.

12. The shoe or boot of claim 11 where said inflection area is positioned anterior said impact axis.

13. The shoe or boot of claim 11 where said sole has a length from a heel end to a toe end, said inflection area positioned between 18 and 32 percent of the length from said heel end.

14. The shoe or boot of claim 11 where said sole has a length from a heel end to a toe end, said inflection area positioned at least 25 percent of the length from said heel end.

15. The shoe or boot of claim 11 where said sole has a length from a heel end to a toe end, said plate heel having a measure of between 18 and 32 percent of the length.

16. The shoe or boot of claim 11 where said sole has a length from a heel end to a toe end, said impact line positioned between 18 and 32 percent of the length from said heel end.

17. The shoe or boot of claim 11 where said plate heel is generally flat and is oriented horizontally and said plate forefoot is generally flat and is oriented horizontally.

18. The shoe or boot of claim 11 where said plate has a first maximum length and said plate slope spans a longitudinal distance of a second length, said second length being at least 30% of the first maximum length.

19. The shoe or boot of claim 11 where said sole has a length from a heel end to a toe end, said inflection area positioned at about 27% of the length from said heel end.

20. The shoe or boot of claim 11 where said sole has an upper side and a lower side and said plate heel is positioned closer to the upper side of said sole than the lower side of said sole and said plate forefoot is positioned closer to the lower side of said sole than the upper side of said sole.

21. The shoe or boot of claim 11 where said plate slope is positioned at or near a medial edge of said sole, said plate defining a lateral void.

22. The shoe or boot of claim 11 where said plate forefoot is substantially rigidly connected to said plate heel via said plate slope.

23. The shoe or boot of claim 11 where said plate slope spans a longitudinal distance of about one third of a total length of said plate.

24. A shoe or boot comprising:

a sole and an upper, said sole comprising:

a plate having a plate heel, a plate slope and a plate forefoot, said plate slope sloping downward from said plate heel to said plate forefoot, said plate slope spans a longitudinal distance of about one quarter of a total length of said sole, padding positioned above said plate, said padding having a thickness which increases from a posterior to an anterior of said plate slope; and said plate heel is positioned at or near an upper surface of said sole and said plate forefoot is positioned at or near a lower surface of said sole.

25. The shoe or boot of claim 24 where said plate heel is generally flat and oriented horizontally and said plate forefoot is generally flat and oriented horizontally.

26. The shoe or boot of claim 24 where said sole has a length from a heel end to a toe end, said plate slope sloping downward from said plate heel at an inflection area, said plate slope spans a longitudinal distance of between 23% and 29% of the length of said sole.

27. The shoe or boot of claim 24 where said plate slope spans a horizontal distance of approximately 30% of a total length of said plate.

28. The shoe or boot of claim 24 wherein said plate slope defines a lateral void.

29. The shoe or boot of claim 24 where said plate spans a partial width of said sole at said plate slope, said plate slope oriented at or adjacent a medial edge of said sole.

30. A shoe or boot comprising:

a sole and an upper, said sole comprising:

a plate having a plate heel and a plate slope sloping downward from said plate heel, said plate slope spans a partial width of said sole, at least a portion of said plate slope positioned at or near a medial edge of said sole, said plate defining a lateral void;

padding positioned at the lateral void; and padding positioned above said plate and having a thickness which increases form a posterior to an anterior of said plate slope.

31. The shoe or boot of claim 30 where said sole has an upper side and a lower side, said plate slope extends to a plate forefoot, said plate heel positioned closer to the upper side of said sole than the lower side of said sole, said plate forefoot positioned closer to the lower side of said sole than the upper side of said sole.

32. A shoe or boot comprising:

a sole; and an upper, the sole having a length between a heel end and a toe end, an upper side and a lower side, the sole having a plate with a plate heel, a plate slope, and a plate forefoot, the plate slope sloping downward form the plate heel to the plate forefoot, the sole having a posterior-most aspect in contact with a surface with the shoe or boot resting naturally upon the surface, the plate heel extending posteriorly of the posterior-most aspect and positioned closer to the upper side of the sole than the lower side of the sole, the plate forefoot positioned closer to the lower side of the sole than the upper side of the sole.

33. The shoe or boot of claim 32 wherein the bottom side of the sole slopes upwardly from the posterior-most aspect to the heel end.

34. The shoe or boot of claim 32 where at least substantially an entirety of the plate heel extends posteriorly of the posterior-most aspect.

* * * * *